United States Patent [19]

Ushiro

[11] Patent Number: 4,624,394

[45] Date of Patent: Nov. 25, 1986

[54] TUBE CONTAINER SQUEEZER

[75] Inventor: Masayuki Ushiro, Muko, Japan

[73] Assignee: Kyoto Kikai Kogu Kabushiki Kaisha, Kyoto, Japan

[21] Appl. No.: 556,023

[22] Filed: Nov. 29, 1983

[30] Foreign Application Priority Data

Nov. 30, 1982 [JP] Japan ..... 57-180015[U]
May 18, 1983 [JP] Japan ..... 58-75017[U]

[51] Int. Cl.[4] ..... B65D 35/28
[52] U.S. Cl. ..... 222/103; 222/391
[58] Field of Search ..... 222/105, 97–103, 222/391

[56] References Cited

U.S. PATENT DOCUMENTS 2,056,422 10/1936 Crossley ..... 222/101
2,148,321 2/1939 Oplinger ..... 222/103
2,512,210 6/1950 McGrath ..... 222/103
3,604,418 9/1971 Jones ..... 222/102 X
3,774,816 11/1973 Bratton ..... 222/391
3,997,085 12/1976 Lindquist ..... 222/391 X

FOREIGN PATENT DOCUMENTS 954094 9/1974 Canada ..... 222/102
212760 3/1941 Switzerland ..... 222/105

*Primary Examiner*—Charles A. Marmor
*Attorney, Agent, or Firm*—Martin Smolowitz

[57] ABSTRACT

A tube squeezer comprises a main frame in the shape of pistol, a thrust rod slidably supported by the main frame, an intermittent feeding mechanism for shifting the thrust rod intermittently, a holding part for holding tightly the tail end of a tube to be squeezed and a squeezing part fixed to the front end of the thrust rod for squeezing the tube. The squeezing part has two squeezing members between which the tube is squeezed. With the tail end of the tube held by the holding part, the squeezing part is moved forward intermittently by actuating a trigger lever.

1 Claim, 14 Drawing Figures

FIG. 1
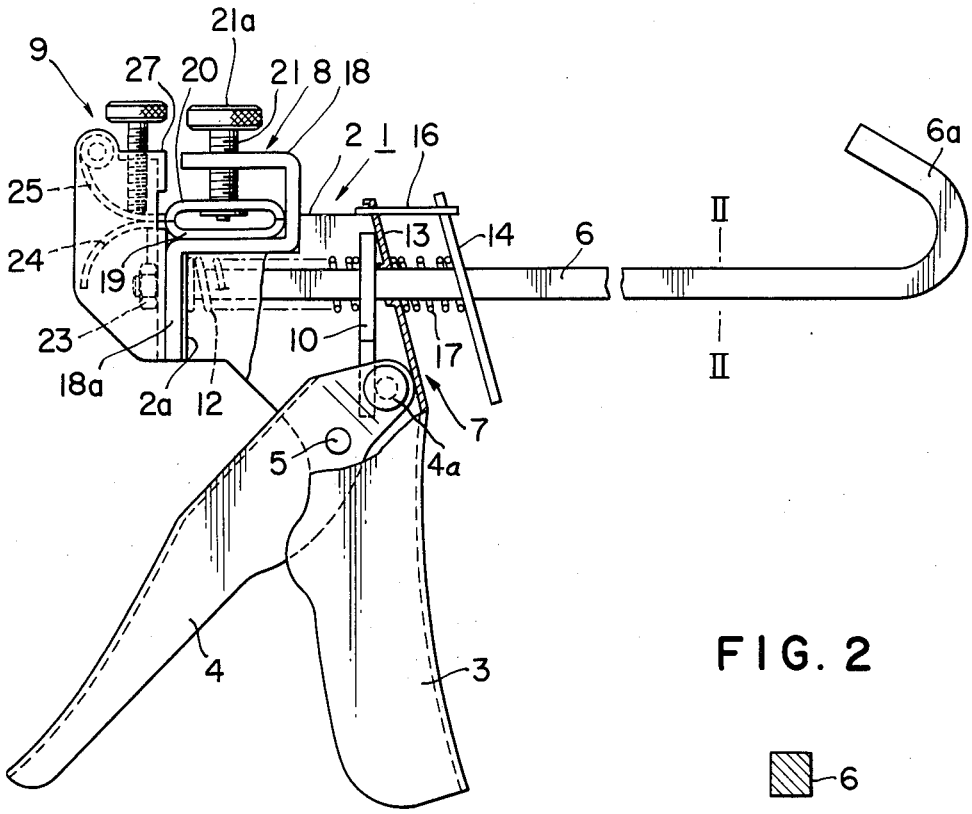
FIG. 2
FIG. 3
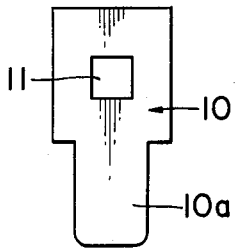
FIG. 4
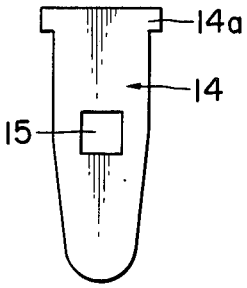

TUBE CONTAINER SQUEEZER

BACKGROUND OF THE INVENTION

This invention relates to a tube squeezer for dispensing the content of a collapsible tubular container (hereinafter referred to as a tube) and deals more particularly with a tube squeezer for a tube containing adhesive materials such as architectual caulking materials and the like.

It is hard work to squeeze caulking material from a tube by hand during construction work because the caulking material has a high degree of adhesion or tackiness and high viscosity. Therefore, a caulking gun is conventionally used for squeezing the caulking material from its tube. One type of such a caulking gun as disclosed in U.S. Pat. No. 3,187,951 has a mechanism for stripping the caulking material from two tubes accommodated parallel to each other in a casing. In the casing is provided a feed screw with which a carriage is engaged so as to be moved along the feed screw. On each side of the carriage are connected two squeezing rolls between which each of the tubes is squeezed. The feed screw is rotated by an electric motor in a gun-shaped hand drill. When the feed screw is rotated by the motor, the rolls move from the tail of the tube to the head thereof while squeezing the tube by pressing it from the upward and downward directions.

In this type of the caulking gun, an electric drill is used to rotate the feed screw. This makes the entire gun heavy. In addition, a mechanism for transmitting the driving force of the motor to the carriage is very complicated.

A hot melt adhesive gun similar to the caulking gun is also known. In one known type of hot melt adhesive gun which is disclosed in U.S. Pat. No. 4,033,484, a cartridge containing thermoplastic adhesive is held in a cylindrical chamber formed on a main body in the shape of a pistol. A plunger is driven into engagement with the cartridge by a manually operative trigger to provide pressure for pushing the adhesive out of the cartridge. The plunger is gradually moved forward by an infinite resolution ratchet mechanism to press the bottom of the cartridge as a trigger lever is actuated by hand.

In this hot melt adhesive gun, as the infinite resolution ratchet mechanism is used for gradually moving the plunger by hand, the gun is not very heavy. However, this gun is for squeezing the adhesive in a cylindrical cartridge and cannot squeeze the adhesive from a tube containing the adhesive.

Moreover, U.S. Pat. No. 3,221,940 teaches a tube squeezer for dispensing the content of a conventional toothpaste tube. The tube squeezer has a hollow body in which a tube is received. In this hollow body is provided a squeezer block in which two rolls are accommodated. The squeezer block is moved forward by actuating a handle provided at the front end of the hollow body, while the two rolls rotate as they press against the opposite surfaces of the tube.

In this type of tube squeezer, it is troublesome to set the tube in the hollow body because, at that time, the spout of the tube must be registered with an opening in the forward wall of the hollow body. Furthermcre, a driving mechanism for moving the squeezer block is not strong enough to squeeze adhesive materials having a high degree of tackiness and high viscosity such as caulking materials.

In addition, U.S. Pat. No. 3,999,688 teaches a shrouded tube squeezer having a pair of rollers which are adapted to be rotated by a key embedded in one of the rollers. These rollers are accommodated in a shroud housing having entrance and exit slits for passing a tube between the rollers. In this tube squeezer, the shroud housing is moved forward by rotating the winding key with one hand while the tail of the tube is held by the other hand. The shroud housing is moved manually and accordingly adhesive materials of high viscosity and tackiness cannot be squeezed by a tube squeezer of this construction.

SUMMARY OF THE INVENTION

It is an object of this invention to provide a tube squeezer which can easily and reliably squeeze a tube containing a material of high tackiness and high viscosity to apply the material to a desired working region.

Another object of this invention is to provide a tube squeezer in which any type of tube can be promptly set.

According to this invention, briefly summarized, there is provided a tube squeezer for squeezing the content of a collapsible tube, which comprises: a main frame in the shape of a pistol; a thrust rod supported so as to slidably extend through the main frame; an intermittent feeding means for intermittently moving the thrust rod by actuating a trigger, said feeding means being adapted to move forward the thrust rod when the trigger is actuated and remain at its position when the trigger is released; a holding means fixed to the front portion of the main frame for holding the tail end of the tube; and a squeezing means fixed to the front end of the thrust rod in a position opposite to the holding means for squeezing the tube, said squeezing means having two squeezing members between which the tube is pressed while the members move on the surface of the tube with its tail end held by the holding means, at least one of the squeezing members being movable so that a space between them is adjusted, the tube being passed through the space.

The nature, utility, and further features of this invention will be more clearly apparent from the following detailed description with respect to preferred embodiments of the invention when read in conjunction with the accompanying drawings briefly described below.

BRIEF DESCRIPTION OF THE DRAWINGS

In the drawings

FIG. 1 is a left side elevation view, with parts cut away, of a tube squeezer according to the invention;

FIG. 2 is a sectional view taken along the line II—II in FIG. 1;

FIG. 3 is a front elevation view of a feeding plate in the tube squeezer;

FIG. 4 is a front elevation view of a stop plate in the tube squeezer;

DETAILED DESCRIPTION OF THE INVENTION

Figure 5:
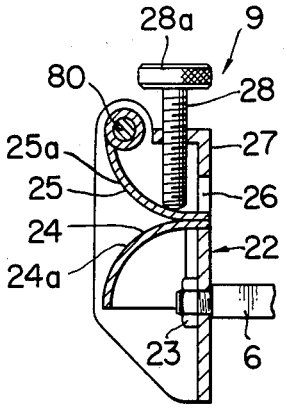
FIG. 5 is a left side elevation, partially in vertical section, of a squeezing part.

In FIG. 1, a tube squeezer 1, in the shape of a gun or pistol, has a main frame 2. The lower portion of the frame 2 forms a grip 3, in the upper portion of which a trigger-like actuating lever (hereinafter referred to as a trigger) 4 is pivoted by a pivot pin 5. A thrust rod 6 is so supported in the upper portion of the frame 2 as to be slidable horizontally. The thrust rod 6 is moved forward by distance intervals of a certain pitch by an intermittent feeding mechanism 7.

In the front part of the frame 2 is supported a holding part 8 for holding the tail of a tube (not shown in FIG. 1), and to the front end of the thrust rod 6 is fixed a squeezing part 9 for pressing the tube when the thrust rod 6 is moved forward.

The thrust rod 6 is rectangular in transverse section as shown in FIG. 2, and the rear portion of the rod 6 is bent so as to form a hook portion 6*a*, which serves to prevent the rear portion thereof from disengaging from the frame 2 when the rod 6 is moved extremely forward and also to suspend the tube squeezer 1 from a suspending member such as a nail or hook.

The intermittent feeding mechanism 7 is well known and has a construction as briefly described below.

With the front portion of the thrust rod 6 is engaged a feeding plate 10 which has a rectangular opening 11 and a tongue portion 10*a* as shown in FIG. 3. The front portion of the rod 6 passes through the opening 11 and the tongue portion 10*a* abuts against a transverse pin 4*a* fixed to the upper end of the trigger 4. The feeding plate 10 is urged rearward by a coil spring 12 provided around the front portion of the thrust rod 6. When the trigger 4 is released, the feeding plate 10 is moved rearward until its upper end abuts against the rear inclined wall 13 of the frame 2.

A stop plate 14 is provided rearward away from the rear wall 13 and has a rectangular opening 15 as shown in FIG. 4, through which the thrust rod 6 passes horizontally. The upper part of the stop plate 14 projects outward in opposite lateral directions to form an engaging head 14*a* which is pivotally hung on a supporting member 16, so that the stop plate 14 can swing in the front and rear directions. Between the rear wall 13 and the stop plate 14 is provided a coil spring 17 to keep the stop plate 14 inclined as shown in FIG. 1 when the trigger 14 is released or not actuated.

When the trigger 4 is slightly pulled toward the grip 3, that is, in FIG. 1, when the trigger 4 is slightly rotated in the counterclockwise direction about the pivot pin 5, the tongue portion 10*a* of the feeding plate 10 is moved forward. Thus, the feeding plate 10 is inclined on the thrust rod 6 so that the upper and lower edges of the rectangular opening 11 bite against the upper and lower surfaces of the thrust rod 6. With successive actuation of the trigger 4, the feeding plate 10 is moved forward while holding the thrust rod 6. At this time, the stop plate 14 swings forward so that the biting action of the upper and lower edges of the rectangular opening 15 of the stop plate 14 relative to the surfaces of the thrust rod 6 is stopped. Thus, the stop plate 14 does not prevent the thrust rod 6 from moving forward.

When the trigger 4 is released, the feeding plate 10 is returned to the initial position by the restoring force of the coil spring 12 while sliding on the surface of the thrust rod 6. At this time, however, the coil spring 17 between the rear wall 13 and the stop plate 14 returns the stop plate 14 to the initial inclined position, and accordingly when the thrust rod 6 is moving rearward, the upper and lower edges of opening 15 of the stop plate 14 bite strongly against the surfaces of the thrust rod 6 thereby to prevent the thrust rod 6 from moving rearward.

The holding part 8 has a frame 18 in the shape of the letter U laid on its side as viewed in the lateral direction, which is fixed to the front part of the main frame 2 and has an integral vertical wall part 18*a* extending downward from the front part of the lower flange of the frame 18. On the bottom of the U-shaped frame 18 is mounted a lower nipping member 19 which cooperates with an upper nipping member 20 to hold or nip the tail of a tube. The upper nipping member 20 is connected to the lower end of a fastening screw 21, which is engaged with the upper horizontal flange portion of the U-shaped frame 18 so as to move vertically when a head 21*a* of the screw 21 is turned. The lower vertical wall 18*a* of the frame 18 and the front wall 2*a* of the frame 2 have rectangular openings (not shown) respectively, through which the front end of the thrust rod 6 passes.

Figure 6:
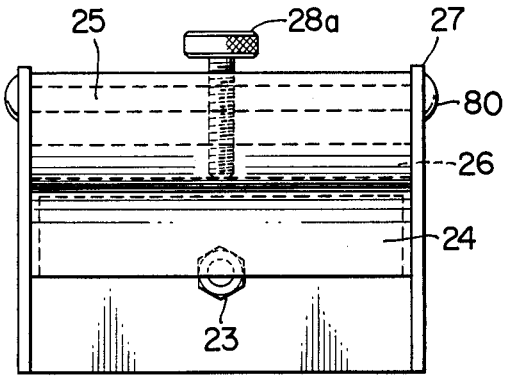
FIG. 6 is a front elevation of the squeezing part.

The squeezing part 9 has a body 22 which has a vertical transverse wall 27 and is fixed to the front end of the thrust rod 6 by a nut 23 as shown in FIGS. 5 and 6. In the body 22 are provided two squeezing plates 24 and 25 which are each formed in the shape of an arc, in vertical section as viewed transversely, corresponding to a quarter of a circle. The convex arcuate faces 24*a* and 25*a* of the respective squeezing plates 24 and 25 are opposed to each other and diverge or flare gradually forward in the form of a trumpet. The lower squeezing plate 24 is fastened to the body 22, while the upper squeezing plate 25 is so mounted on the body 22 as to swing about a horizontal transverse pin 80 engaged with the upper portion of the upper plate 25. The body 22 has an opening 26 in the vertical wall 27 of the body 22, and the lower portion of the upper squeezing plate 25 is inserted into the opening 26.

Moreover, an adjusting screw 28 is provided for adjusting the space between the rear portions of the lower plate 24 and the upper plate 25, and is moved vertically when a head 28*a* of the screw 28 is rotated by hand.

The operation of this tube squeezer is as follows.

Prior to the use of the squeezer, the adjusting screw 28 and the fastening screw 21 are moved upward, respectively. Then, the tail portion of the tube 30 is passed through the space between the rear portions of the two squeezing plates 24 and 25 to be held strongly at its rolled tail end between the two nipping members 19 and 20. Thereafter, the adjusting screw 28 is rotated to be moved downward thereby to lower the rear portion of the upper plate 25, whereby the rear portion of the tube 30 is pressed between the rear portions of the two squeezing plates 24 and 25.

Subsequently, at the time of caulking work, the trigger 4 is squeezed to push the thrust rod 6 forward by a specific distance. The forward movement of the thrust rod 6 causes the squeezing part 9 to move forward while the upper and lower squeezing plates 24 and 25 squeeze the surface of the tube 30, whereby a certain amount of caulking material 31 contained in the tube 30 is squeezed out of the nozzle or spout 32 thereof.

Figure 7:
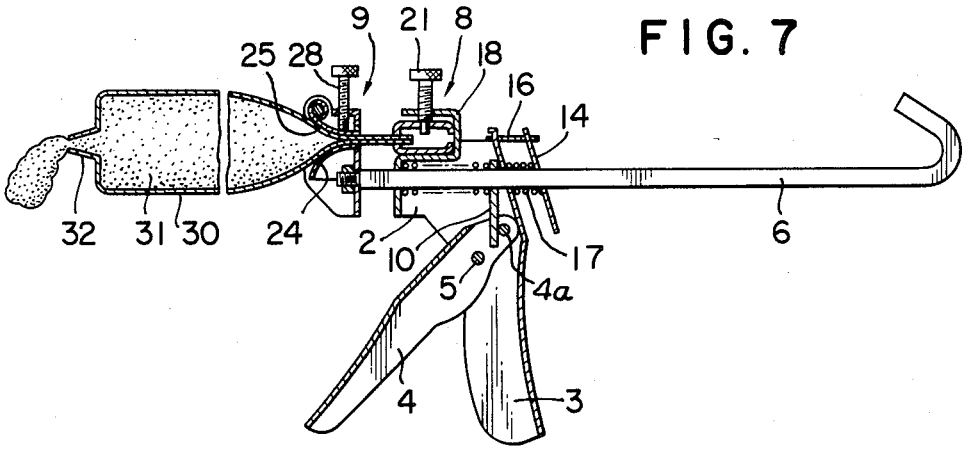
FIG. 7 is a left side elevation view of the tube squeezer shown in a state wherein it is squeezing a tube.

When the trigger 4 is released, the feeding plate 10 is returned to the initial position by the coil spring 12 with the thrust rod 6 remaining at its position as illustrated in FIG. 7. The movement of the thrust rod 6 has already been described above. The squeezing part 9 is gradually moved forward to push the caulking material out of the spout 32 by squeezing the tube 30 from behind when the squeezing actuation of the trigger 4 is repeated.

After the total amount of the caulking material in the tube 30 has been squeezed out, the adjusting screw 28 and the fastening screw 21 are loosened to permit pulling of the empty tube 30 out of the holding and squeezing parts 8 and 9. Thus, the empty tube 30 can be released easily from the tube squeezer 1.

In the present invention, as the main frame 2 is formed in the shape of a pistol and the intermittent feeding mechanism 7 for moving forward the thrust rod 6 is associated with the trigger 4, a great driving force for moving forward the thrust rod 6 can be provided even with only one hand. Furthermore, the holding part 8 can hold tightly the tail end of the tube 30 while the squeezing portion 9 can squeeze the tube 30 smoothly due to the provision of the curved squeezing plates 24 and 25 and the capability of adjustment of the space between the two plates 24 and 25 by the adjusting screw 28.

Accordingly, the present tube squeezer 1 can squeeze easily and reliably a tube containing material of high viscosity and tackiness such as caulking material.

Furthermore, the construction of the squeezing plates 24 and 25 is not limited to that of the above description and as illustrated in the drawings, and squeezing plates of various shapes may be employed.

In addition, as the thrust rod 6 has a cross section of rectangular shape and the openings, of the main frames 2, for receiving the thrust rod are also in the shape of a rectangle, the thrust rod cannot revolve around it longitudinal axis. Accordingly, the relative position between the holding and squeezing portions is retained without the provision of a guide member for preventing the rod 6 from revolving around its axis during the squeezing operation.

FIGS. 8 through 13 show other examples according to this invention of the holding part for nipping the tail end of a tube and the squeezing part for squeezing the tube.

Figure 8:
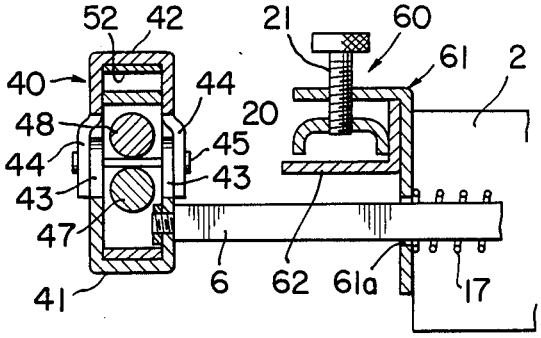
FIG. 8 is a left side elevation, partially in vertical section, showing another example of the front portion of the squeezer.
Figure 9:
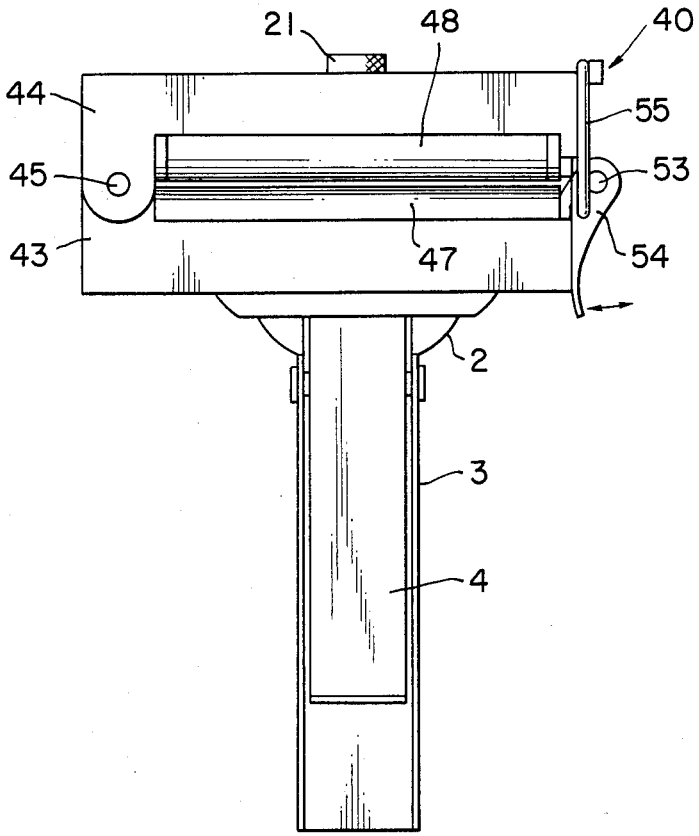
FIG. 9 is a front elevation of the squeezer as shown in FIG. 8.
Figure 10:
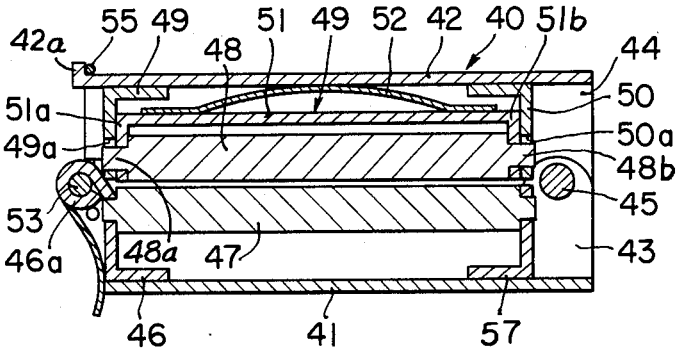
FIG. 10 is a front elevation, in vertical section, showing a squeezing part of the squeezer as shown in FIGS. 8 and 9.

In FIGS. 8 through 10, on the front end of the thrust rod 6 is supported a squeezing part 40 which comprises a lower frame 41 extending perpendicular to the rod 6 and an upper frame 42 cooperating with the lower frame 41. The upper frame 42 is pivotably engaged to the lower frame 41 at its one end, and the upper and lower frames 41 and 42 are openable relative to each other. At one end of the lower frame 41 in the lateral direction are provided two projections 43 and 43 spaced apart in the front-rear direction, while the upper frame 42 is provided with two projections 44 and 44 opposite to the projections 43 and 43 of the lower frame 41. The projections 43 and 44 are connected pivotably to each other by a pivot pin 45 extending horizontally.

To the lower frame 41 are fixed two supporting plates 46 and 57 spaced apart in the lateral direction and each in the shape of a letter L to support rotatably a lower roll 47 therebetween, while an upper roll 48 is rotatably supported by two supporting plates 49 and 50 fixed apart from each other to the upper frame 42. The upper roll 48 is held by an inner frame plate 51 which is so engaged to the two supporting plates 49 and 50 as to move vertically. The two lateral ends of the upper roll 48 are rotatably supported by two vertical walls 51*a* and 51*b* of the inner frame plate 51 and are respectively projected into two slots or elongated holes 49*a* and 50*a* formed in the respective lower portions of the supporting plates 49 and 50. Between the horizontal wall 49*b* of the inner frame plate 51 and the inner horizontal wall of the upper frame 42 is provided a leaf spring 52 which functions to urge the inner frame 49 downward. Instead of the leaf spring 52, a coil spring (not shown) may be employed. The elongated holes 49*a* and 50*a* extend longer vertically than the diameter of the slender end portions 48*a* and 48*b* of the upper roll 48, thereby to permit the upper roll 48 to move vertically according to the thickness of the tube to be squeezed.

Figure 11:
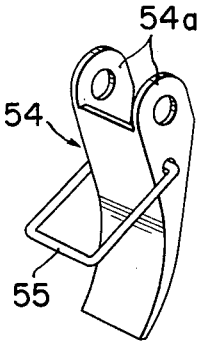
FIG. 11 is a perspective view showing a buckle for fastening the squeezing part.

The supporting plate 46 fixed to the lower frame on its left side in FIG. 10 has a cylindrical portion 46*a* at its upper end which is formed in such a manner that the upper portion of the plate 46 is rolled about a pin 53 in a position offset from the left ends of the two frames 41 and 42. The pin 53 rotatably supports a buckle 54. The buckle 54 has a metal ring 55 pivotally supported at its side flange walls 54*a* and 54*a* as shown in FIG. 11. The ring 55 is hung on the stopper 42*a* formed at the lateral end of the upper frame 42 when the upper frame 42 covers over the lower frame 41 to squeeze the tube between the upper and lower rolls 47 and 48.

FIG. 8 also shows another embodiment of the holding part. In FIG. 8, a holding part 60 has a frame 61 in the shape of an inverted letter L to which a receiving plate 62 is fixed. The vertical portion of the frame 61 is fixed to the front end of the main frame 2 and is provided with an aperture 61*a* through which the thrust rod 6 extends horizontally. The horizontal portion of the frame 61 supports the fastening screw 21, the lower end of which has the nipping member 20. The tail end of the tube to be squeezed is tightly held between the horizontal portion of the receiving plate 62 and the nipping member 20.

When the tube 30 is set in the tube squeezer 1, the metal ring 55 is released from the stopper 42*a* of the upper frame 42 to swing the upper frame 42 upwardly about the pivot pin 45 which connects pivotably the lower and upper frames 41 and 42 to each other. Afterward, the tail end of the tube 30 is fastened between the nipping member 20 and the horizontal portion of the receiving plate 62, and the upper frame 42 of the squeezing portion 40 is closed by rotating the buckle 54 downward while the metal ring 55 is hung on the stopper 42*a*.

Figure 12:
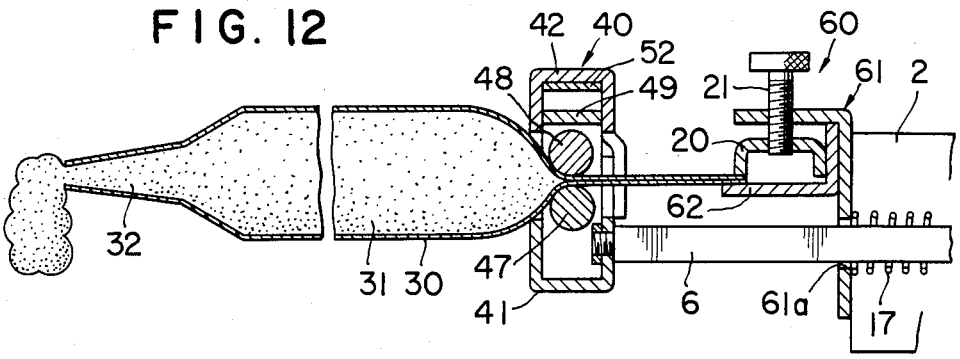
FIG. 12 is a left side elevation, partially in vertical section, of the front portion of the squeezer during its squeezing operation.

When under this condition, the trigger 4 is actuated, the thrust rod 6 is gradually moved forward to squeeze the tube 30 as shown in FIG. 12. At this time, the squeezing rolls 47 and 48 roll on the surfaces of the tube 30 while squeezing it.

Nowadays, various kind of tubes are used for containing adhesive materials. For example, special tubes made of tube material having differing thickness depending on the position thereon are on the market. Furthermore, in some tubes, the thickness of tube material is not uniform due to a problem in the manufacture of the tubes.

However, even if such tubes are set in this tube squeezer 1, the upper roll 48 can move vertically through a distance corresponding to the length of the elongated hole 49*a* and 50*a* thereby to compensate for the lack of uniformity in thickness of the tube material. Thus, the squeezer 1 can squeeze a variety of tubes smoothly without sticking of the squeezing rolls 47 and 48 on the tube surfaces. In addition, the squeezer 1 can squeeze completely the entire amount of caulking material 31 out of the tube spout 32, because the upper squeezing roll 48 moves upward and downward according to the thickness of the tube material. Furthermore, it is not necessary to adjust the space between the lower and upper squeezing rolls 48 and 49 according to kind of tube prior to the use of this device.

Figure 13:
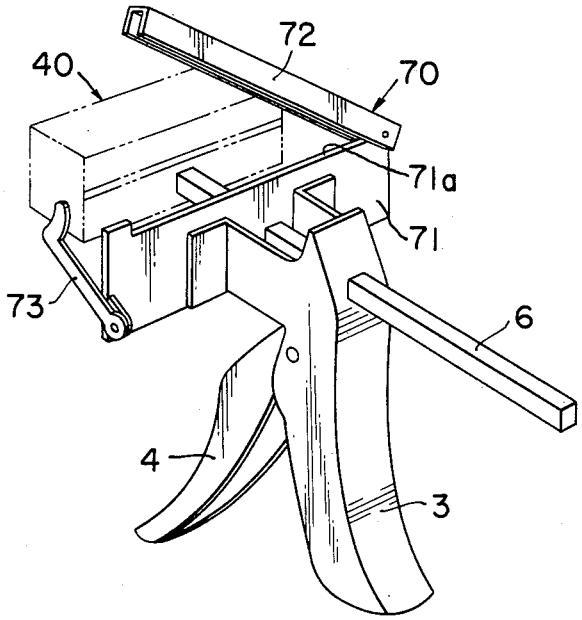
FIG. 13 is a perspective view showing another example of a holding part for holding the tail end of a tube.
Figure 14:
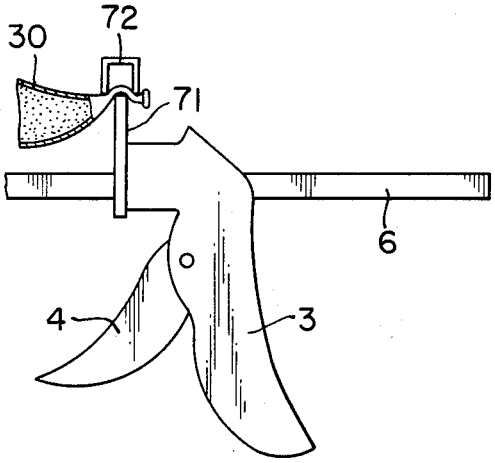
FIG. 14 is a left side elevation of the holding part shown in FIG. 13 shown in a state where the tail end of a tube is held therein.

FIGS. 13 and 14 show still another example of a holding part for holding the tail end of the tube. The holding part 70 comprises a lower holding plate 71 mounted vertically on the main frame 2 and an upper holding bar 72 pivoted at the upper corner of the lateral end of the lower holding plate 71. The upper holding bar 72 has an inverted channel shape in cross section. At the lateral end of the lower holding plate 71 is pivotably mounted a hook 73 which serves to fasten the upper holding bar 72 to the upper edge 71*a* of the lower holding plate 71, with the tail end of the tube 30 tightly held between the upper holding bar 72 and the upper edge 71*a* as shown in FIG. 14.

In this manner, as the holding part 70 is so formed as to open and close upward and downward, the tail end of the tube 30 can be easily set in the holding part 70. In addition, even in case wherein a tube filled to its tail end portion with an adhesive material is set in the holding part 70, the tail end of the tube can be easily and tightly held by pressing its thick tail end onto the upper edge 71*a* with the upper holding bar 72. That is, in this case, it is not necessary to flatten the tail end for setting it in the holding part.

What is claimed is:

1. A tube squeezer for squeezing out the content of a collapsible tubular container of the type commonly called a tube, comprising:

(a) a main frame in the shape of a pistol, the lower portion of the frame having a grip and trigger-like actuating lever;

(b) a thrust rod having a rectangular form in transverse section and supported non-rotatably in a longitudinally slidable manner through the upper portion of the main frame;

(c) intermittent feeding means for intermittently moving the thrust rod by actuating the trigger lever, said feeding means being adapted to move forward the thrust rod when the trigger is actuated and the thrust rod remain at its position when the trigger is released;

(d) holding means formed on the front portion of the main frame and comprising a frame in the shape of the letter U laid on its side in a manner that the opening part is directed forward to receive the tail end of the collapsible tube, a fastening screw held by a horizontal flange portion of the U-shaped frame and a U-shaped nipping member supported by the fastening screw for tightly holding the tail end of the callapsible tube; and (e) squeezing means fixed to the front end of the thrust rod in a position confronting the holding means for squeezing the collapsible tube when the thrust rod is moved foward by actuating the trigger, said squeezing means comprising a body fixed to the front end of the thrust rod, the body being provided with a vertical wall having an opening through which the tail end of the tube passes to be held by the nipping member of the holding means, said squeezing means further comprising two squeezing members between which the tube is pressed while the members move on and along the opposite surfaces of the collapsible tube with its tail end held by the holding means, at least one of the squeezing members being pivotable around a pin at its forward end so that the space therebetween is adjustable, the tubing being passed through the space, the two squeezing members comprising two squeezing plates which are respectively in the shape of an arc in vertical section, said squeezing plates being so opposed to each other that they form a trumpet-like form in vertical section, and an adjusting screw for adjusting the space between the two squeezing plates, the tube being pressed between the squeezing members while the squeezing means is moved forward on the surface of the tube.

* * * * *